US012446673B2

(12) United States Patent
Chung

(10) Patent No.: US 12,446,673 B2
(45) Date of Patent: Oct. 21, 2025

(54) EYELASH SHAPING IMPLEMENTS

(71) Applicant: Pui Yan Chung, San Diego, CA (US)

(72) Inventor: Pui Yan Chung, San Diego, CA (US)

( * ) Notice: Subject to any disclaimer, the term of this patent is extended or adjusted under 35 U.S.C. 154(b) by 0 days.

(21) Appl. No.: 18/594,952

(22) Filed: Mar. 4, 2024

(65) Prior Publication Data

US 2024/0197052 A1 Jun. 20, 2024

Related U.S. Application Data

(60) Continuation of application No. 17/379,818, filed on Jul. 19, 2021, now Pat. No. 11,918,095, which is a division of application No. 16/259,527, filed on Jan. 28, 2019, now Pat. No. 11,064,779.

(51) Int. Cl.
*A45D 2/48* (2006.01)
*A45D 2/38* (2006.01)

(52) U.S. Cl.
CPC . *A45D 2/48* (2013.01); *A45D 2/38* (2013.01)

(58) Field of Classification Search
CPC . A45D 2/48; A41G 5/02; A21C 9/068; B41K 1/02
See application file for complete search history.

(56) References Cited

U.S. PATENT DOCUMENTS

| | | | | |
|---|---|---|---|---|
| 1,542,014 | A | 6/1925 | Stickel | |
| 2,565,541 | A | 8/1951 | Wolff | |
| 2,636,498 | A | 4/1953 | Servilla | |
| 2,684,679 | A | 7/1954 | Ernest | |
| 3,339,561 | A | 9/1967 | Brickner | |
| 4,070,104 | A | 1/1978 | Rice | |
| 4,305,412 | A | 12/1981 | Nist | |
| 4,791,944 | A | 12/1988 | Stein | |
| 5,816,728 | A | 10/1998 | Nardolillo et al. | |
| 6,412,496 | B1 | 7/2002 | Gueret | |
| 6,644,806 | B2 | 11/2003 | Wu | |
| 6,789,551 | B2 | 9/2004 | Iosilevich | |
| D501,580 | S | 2/2005 | Sugawara | |
| 7,055,529 | B2 * | 6/2006 | Muraki | A45D 2/48 132/217 |
| 8,720,454 | B2 | 5/2014 | Santillan | |
| 9,370,234 | B2 | 6/2016 | Lhoyer | |
| 9,717,315 | B2 | 8/2017 | Horino | |
| 11,064,779 | B2 | 7/2021 | Chung | |
| 11,918,095 | B2 | 3/2024 | Chung | |
| 2006/0005851 | A1 | 1/2006 | Cho | |
| 2007/0163613 | A1 | 7/2007 | Lee | |
| 2014/0216489 | A1 | 8/2014 | Knaus | |
| 2016/0106191 | A1 | 4/2016 | Dorsey | |

* cited by examiner

*Primary Examiner* — Rachel R Steitz
(74) *Attorney, Agent, or Firm* — Genius Patent APC; Bruce Angus Hare

(57) ABSTRACT

An eyelash shaping implement includes: a curved main body; a tool engagement element; and a set of shaping elements arranged along a surface of the curved main body. An eyelash curler insert includes: a body; and multiple shaping elements protruding from the body. An eyelash shaper tool includes: a movable section; a fixed section; and a shaping implement having: a body coupled to the movable section; and at least one shaping element protruding from the body. Shaping elements include spherical protuberances, undulating linear protuberances, and tapered surfaces.

14 Claims, 9 Drawing Sheets

EYELASH SHAPING IMPLEMENTS

CROSS-REFERENCE TO RELATED APPLICATIONS

This application is a continuation of U.S. patent application Ser. No. 17/379,818, filed on Jul. 19, 2021. U.S. patent application Ser. No. 17/379,818 is a division of U.S. patent application Ser. No. 16/259,527, filed on Jan. 28, 2019, which issued as U.S. Pat. No. 11,064,779 on Jul. 20, 2021.

BACKGROUND

Many people use eyelash curlers to modify their appearance. Typically these curlers include a flat surface that engages the eyelashes in order to increase the natural bend of the lashes.

Such flat surface curlers have inconsistent effect across the three-dimensional shape of the eyelashes. In addition, existing solutions do not allow for varying textures or styles and are limited to flat curl enhancement.

Therefore there exists a need for an eyelash shaping implement that allows for varying textures or styles and/or applies uniform curling effect across the eyelash.

SUMMARY

Some embodiments may provide eyelash shaping implements. Such implements may include (and/or be associated with) crimping tools (e.g., eyelash curling tools). Such crimping or applicator tools may allow a user to manipulate the tool (e.g., by squeezing tool handles together) in order to apply pressure onto the eyelashes via a shaping implement (or multiple shaping elements). Shaping elements of some embodiments may be sized and shaped such that the shaping element is able to fit existing lash curling tools.

Each engagement feature described herein may be associated with a complementary engagement feature, such that the engagement features may be directly applied to complementary surfaces of the eyelashes (e.g., the tops and bottoms of the lashes). In some embodiments, the complementary engagement feature may include a flat shaping surface similar to a typical eyelash curler.

Such eyelash shaping implements may include various engagement features related to differing textures or shapes to be applied to the eyelashes. Such features may include, for instance, spherical protuberances, textured surfaces, slanted or undulating surfaces, flat surfaces, etc. Some embodiments may include undulating linear protuberances integrated into the surface of the engagement feature.

Some engagement features may include combinations of elements (e.g., a portion may be flat or sloped, a portion may include spherical protuberances, and a portion may include linear protuberances, etc.). In addition, the engagement features may include elements of varying size, shape, arrangement, etc., as appropriate for different textures, styles, users, etc.

The shaping implements may be made of various appropriate materials (e.g., plastics, silicone, rubber, composites, etc.). Different embodiments may be sized and/or shaped in various different ways depending on factors such as user attributes (e.g., eyelash length, eye size, etc.), preferences (e.g., style, depth, etc.), and/or other appropriate factors.

The preceding Summary is intended to serve as a brief introduction to various features of some exemplary embodiments. Other embodiments may be implemented in other specific forms without departing from the scope of the disclosure.

BRIEF DESCRIPTION OF THE SEVERAL VIEWS OF THE DRAWINGS

The novel features of the disclosure are set forth in the appended claims. However, for purpose of explanation, several embodiments are illustrated in the following drawings.

DETAILED DESCRIPTION

The following detailed description describes currently contemplated modes of carrying out exemplary embodiments. The description is not to be taken in a limiting sense, but is made merely for the purpose of illustrating the general principles of some embodiments, as the scope of the disclosure is best defined by the appended claims.

Various features are described below that can each be used independently of one another or in combination with other features. Broadly, some embodiments generally provide eyelash shaping implements.

A first exemplary embodiment provides an eyelash shaping implement comprising: a curved main body; a tool engagement element; and a set of shaping elements arranged along a surface of the curved main body.

A second exemplary embodiment provides an eyelash curler insert comprising: a body; and a plurality of shaping elements protruding from the body.

A third exemplary embodiment provides an eyelash shaper tool comprising: a movable section; a fixed section; and a shaping implement comprising: a body coupled to the movable section; and at least one shaping element protruding from the body.

Figure 1:
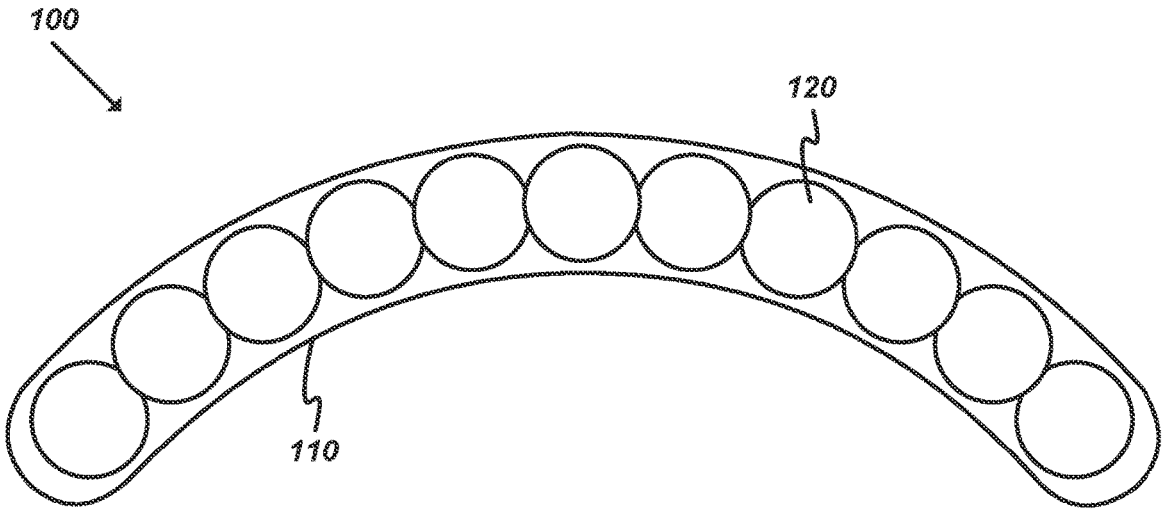
FIG. 1 illustrates a top plan view of an eyelash shaping implement according to an exemplary embodiment.
Figure 2:
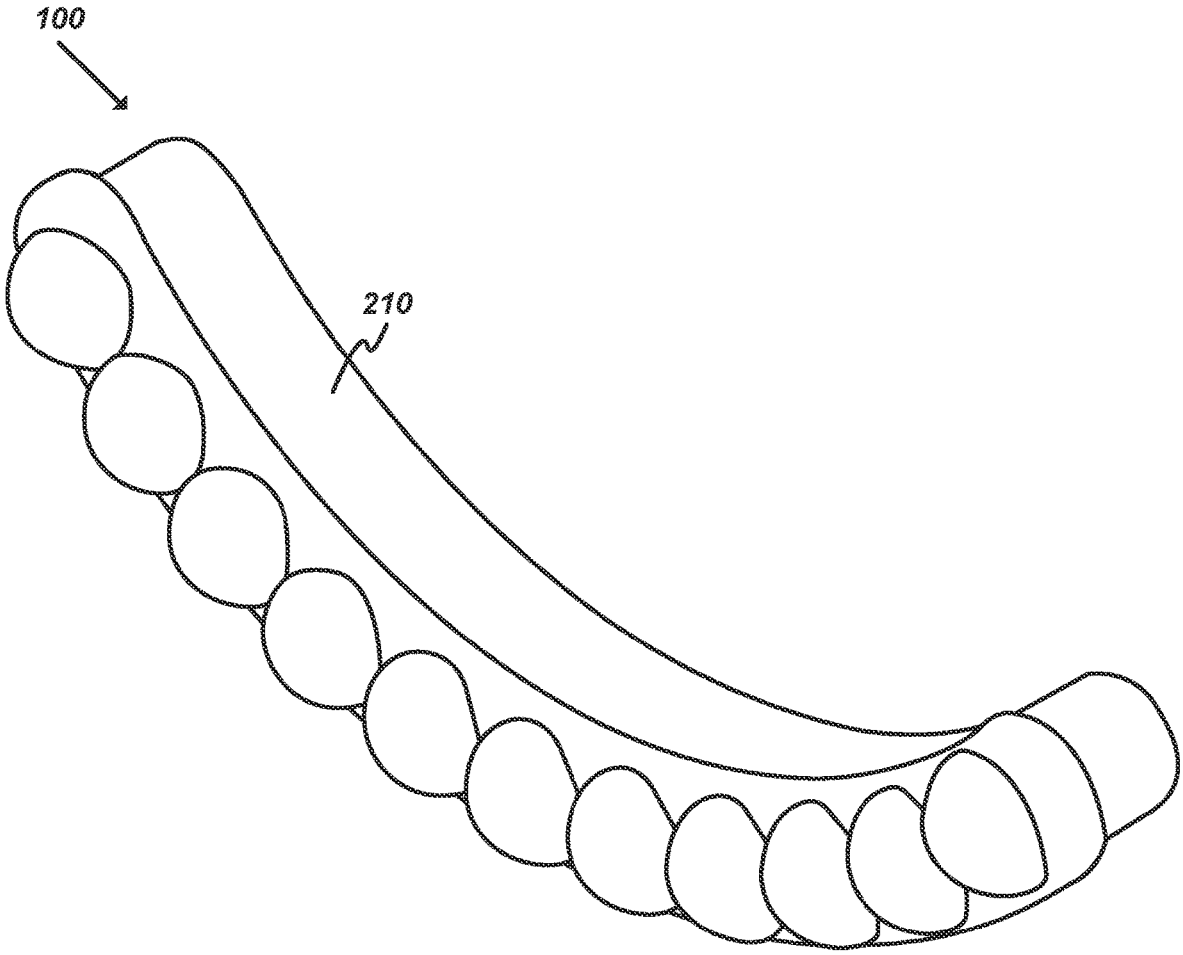
FIG. 2 illustrates a top, front perspective view of the eyelash shaping implement of FIG. 1.
Figure 3:
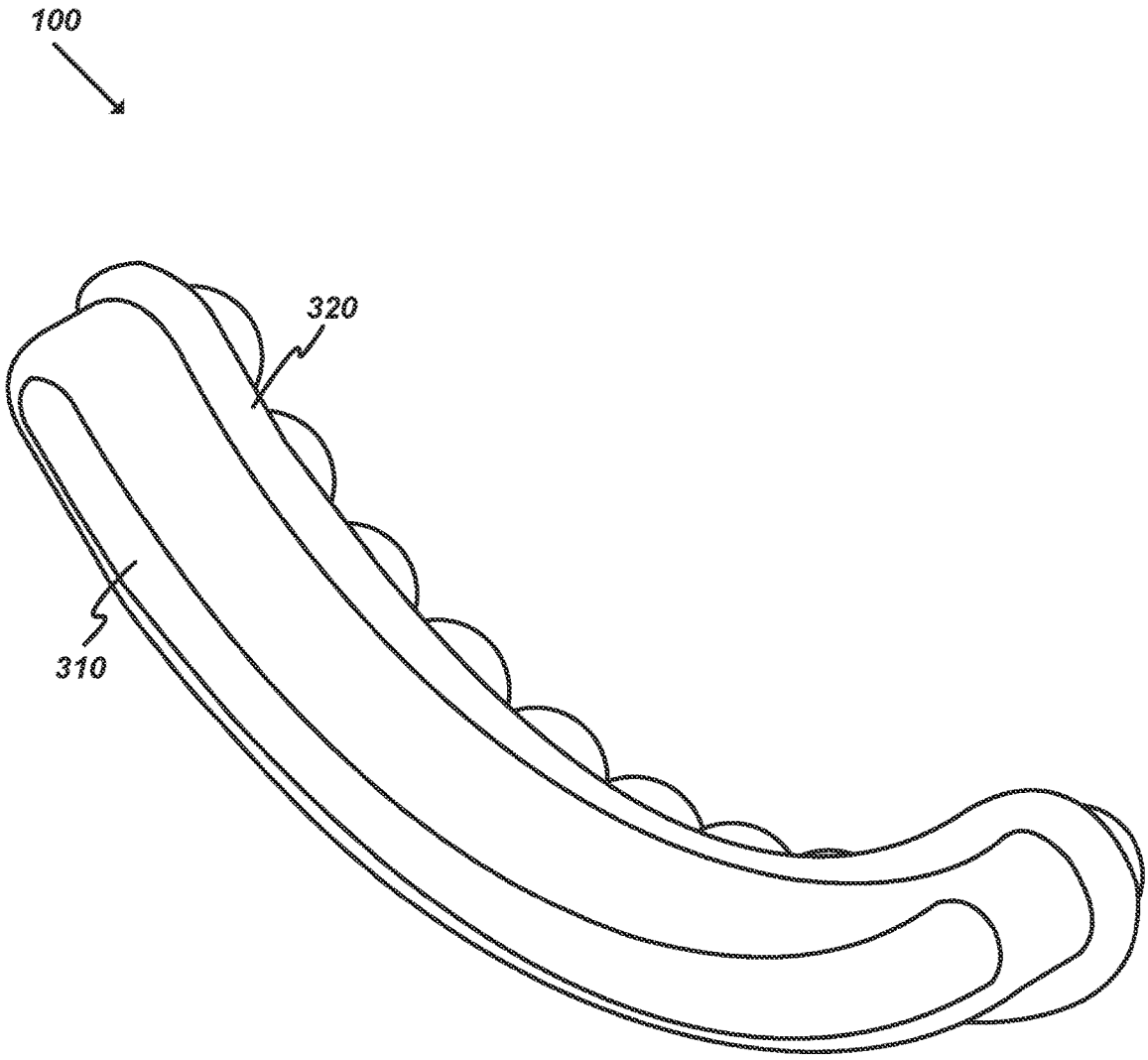
FIG. 3 illustrates a bottom, front perspective view of the eyelash shaping implement of FIG. 1.
Figure 4:
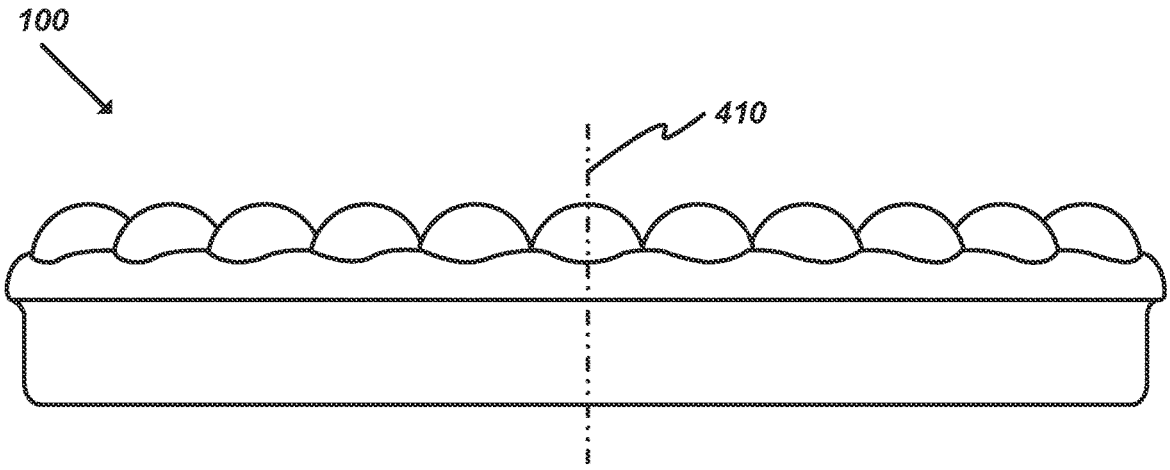
FIG. 4 illustrates a rear elevation view of the eyelash shaping implement of FIG. 1.
Figure 5:
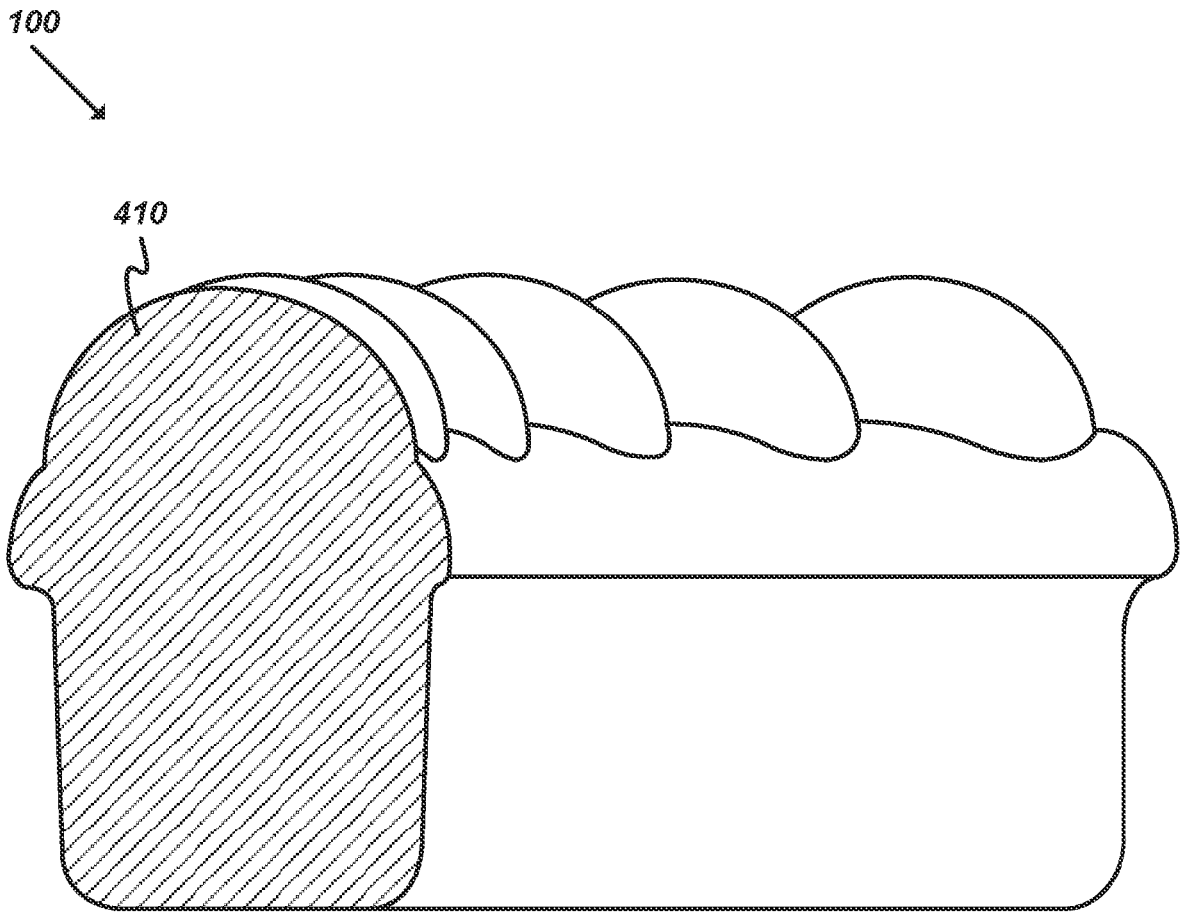
FIG. 5 illustrates a rear, side perspective section view of the eyelash shaping implement of FIG. 1.

FIG. 1 illustrates a top plan view of an eyelash shaper implement 100 according to an exemplary embodiment. FIG. 2 illustrates a top, front perspective view of the eyelash shaping implement 100. FIG. 3 illustrates a bottom, front perspective view of the eyelash shaping implement 100. FIG. 4 illustrates a rear elevation view of the eyelash shaping implement 100. FIG. 5 illustrates a rear, side perspective section view of the eyelash shaping implement 100.

Such an eyelash shaping implement 100 may be inserted into a receptacle of an eyelash curling tool or another appropriate tool or applicator. Such an implement may be referred to as an "insert". In some embodiments, the implement 100 may be embedded into an eyelash tool or otherwise be securely coupled to such a tool (e.g., using screws, adhesives, etc.).

As shown, the implement 100 may include a main body (or "member") 110, a set of shaping features 120, a tool engagement element 210, a recessed base 310, and a retaining ridge 320. Different embodiments may include different specific features, depending on how the implement 100 is to be coupled to a tool, the type(s) of engagement features included in the implement, and/or other relevant factors.

The implement 100 may engage with an opposing complementary member (not shown) having a similar body shape in order to exert shaping force onto the lashes. The complementary engagement feature may have a flat, sloped, and/or pitched surface, as appropriate for the shaping application. The opposing complementary member may be made from various appropriate materials and/or combinations of materials (e.g., rubber, silicone, plastic, metal, etc.) and different embodiments may have different density or hardness, as appropriate for a particular application. In some embodiments, the opposing complementary member may include one or more cavities that may be filled with various fluids.

The main body 110 may be curved such that the implement generally follows the shape of an eye (and also to fit existing tools). In this example, the curve of the main body may be a circular arc. Different embodiments may follow different specific arcs, such as parabolic arcs elliptical arcs, etc. In addition, some embodiments may follow linear paths (e.g., a "V"-shaped path) rather than smooth curves. Some embodiments may include combinations of different specific paths (e.g., a curved portion and a linear portion, curved portions of different radius, etc.). The main body may be a solid element or may include various holes and/or cavities. The main body may include various structural and/or support elements (e.g., a metal or rigid plastic frame or core).

Each shaping feature 120 (spherical protuberances in this example) may engage with an opposing surface to sculpt the lashes as desired. Such arrays of shaping features may produce a three-dimensional undulating texture rather than simply increasing curve depth. Although the shaping features are spherical in this example, one of ordinary skill in the art will recognize that different embodiments may include various different shaping features having different sizes, shapes, arrangements, etc. For instance, shaping features may be cone-shaped, pyramid-shaped, ellipsoid-shaped, and/or otherwise shaped. In this example, the array of shaping features includes a single row centered along a curved center path of the main body 110. Other embodiments may include various other arrays of features 120, including multiple rows and/or columns of features, offset rows and/or columns, etc. In some embodiments, features of different types, shapes, sizes, arrangements, materials, and/or other varying attributes may be included in a single implement 100.

The curler engagement element 210 may extend out from the main body 110 in order to engage an applicator tool (not shown). The engagement element 210 and associated tapered foundation may be sized and shaped such that the element is able to fit into a recess or cavity of an applicator tool. The tapered foundation of the engagement element may allow the implement 100 to fit a variety of existing applicator tools. Some embodiments may include various tabs, slots, protrusions, cavities etc. that may help securely attached the implement to the applicator tool. In addition, some embodiments may include adhesive strips, screws, bolts, nuts, and/or other appropriate coupling features to securely attach the implement to an applicator tool.

The recessed base 310 may provide cushioning or flexibility as well as aiding in proper fitment when coupled with various tools.

The retaining ridge 320 may engage an element of the applicator tool such that the implement 100 is retained at a consistent position relative to the tool. For instance, an applicator tool may include a recess, cavity, frame, etc. that may be able to receive a portion of the engagement element 210. The retaining ridge 320 may be positioned against a wall, surface, member, etc. of the tool such that the implement 100 is securely attached to the tool.

The section view 410 shows the solid core of this example implement 100. The cores of different embodiments may be made from different materials and/or different combinations of materials (e.g., rubber, plastic, silicone, metal, etc.). Furthermore, some embodiments may include hollow sections of the core and/or shaping features 120. Such hollow sections or cavities may be filled with various fluids (e.g., air, gels, etc.). In this way, varying densities or hardness may be achieved, as appropriate for various styling applications. For instance, an application associated with a subtle manipulation of the eyelashes may include shaping features made of soft rubber with at least one cavity in each. Alternatively, an application associated with aggressive manipulation of the eyelashes may include shaping features made of solid, hard rubber or plastic. The base 110 or core, shaping features 120, and/or other elements of the implement 100 may be made from different materials in some embodiments. In some embodiments, the entire implement may be made from a single material (or combination of materials).

Some embodiments may include pairs of inserts 100, where each insert in the pair is associated with a particular eye (i.e., left or right). Such paired inserts may be tapered, pitched, and/or otherwise be asymmetrically shaped, as appropriate to fit each eyelash. One such example is described below in reference to FIG. 10-FIG. 12 below.

Figure 6:
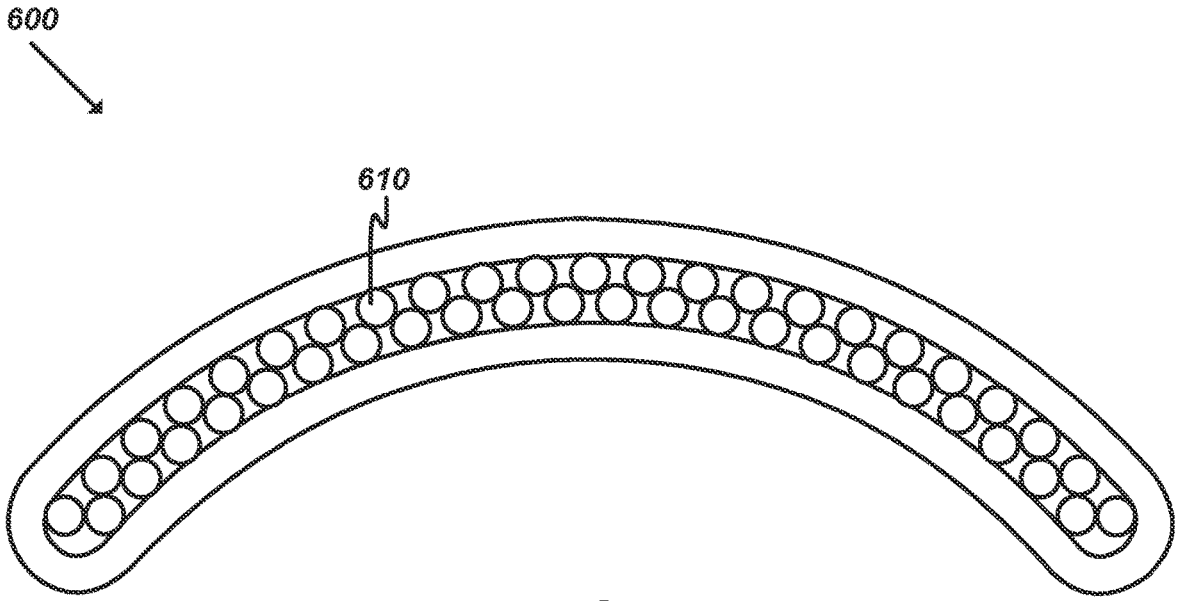
FIG. 6 illustrates a top plan view of a first alternative eyelash shaping implement according to an exemplary embodiment.
Figure 7:
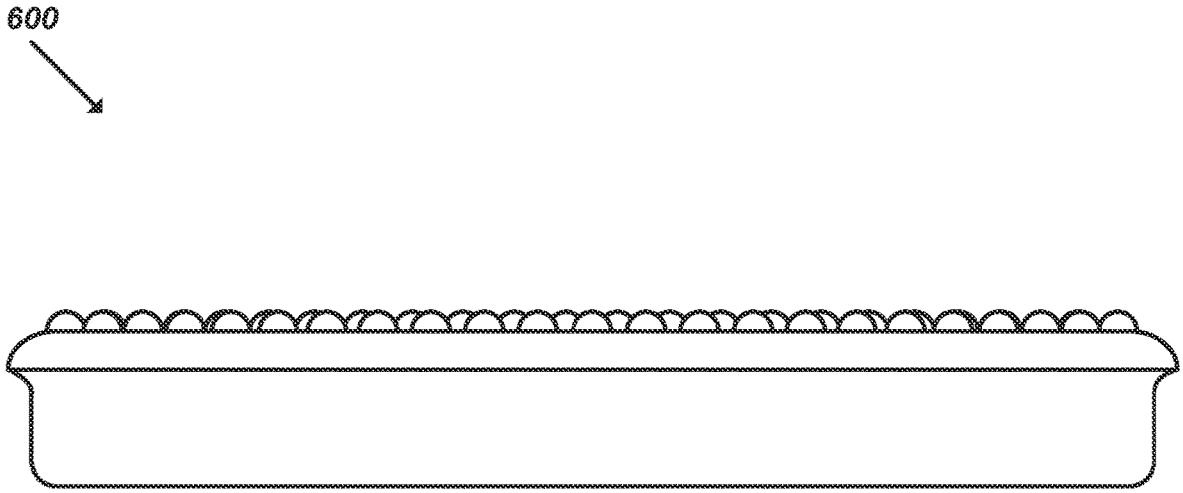
FIG. 7 illustrates a rear elevation view of the first alternative eyelash shaping implement of FIG. 6.

FIG. 6 illustrates a top plan view of a first alternative eyelash shaping implement 600 according to an exemplary embodiment. FIG. 7 illustrates a rear elevation view of the first alternative eyelash shaping implement 600.

The main body and tool engagement elements of the alternative implement 600 may be similar to those from the example implement 100 described above.

As shown, the alternative implement 600 may include a set of petite spherical protuberances 610 arranged in a pair of offset rows. In this example, the array of shaping features 610 includes a pair of rows along two curved paths that are offset from, and centered about, the curved center path of the main body 110.

Figure 8:
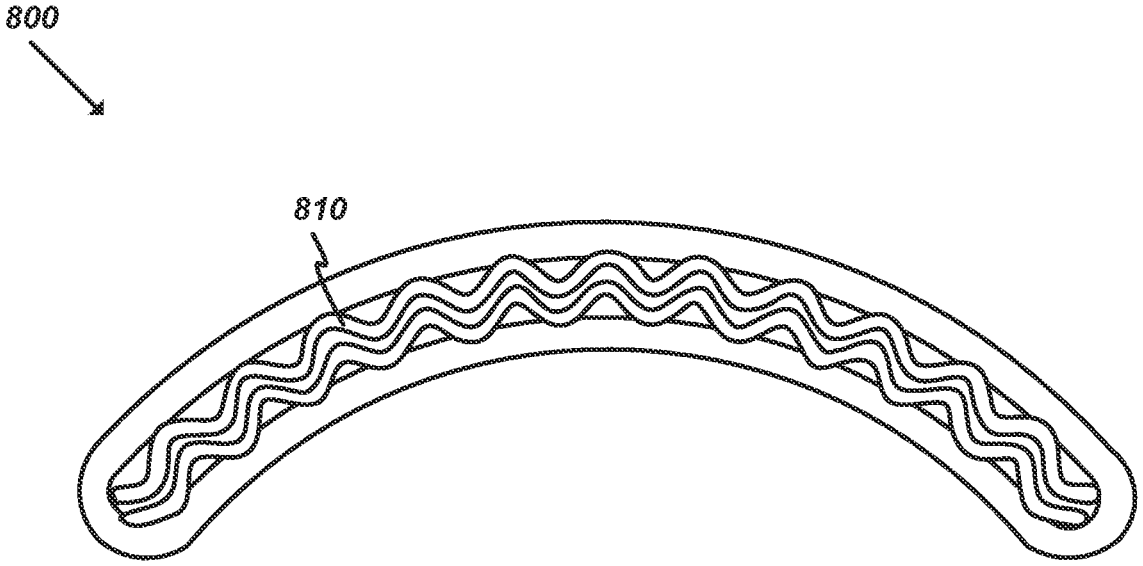
FIG. 8 illustrates a top plan view of a second alternative eyelash shaping implement according to an exemplary embodiment.
Figure 9:
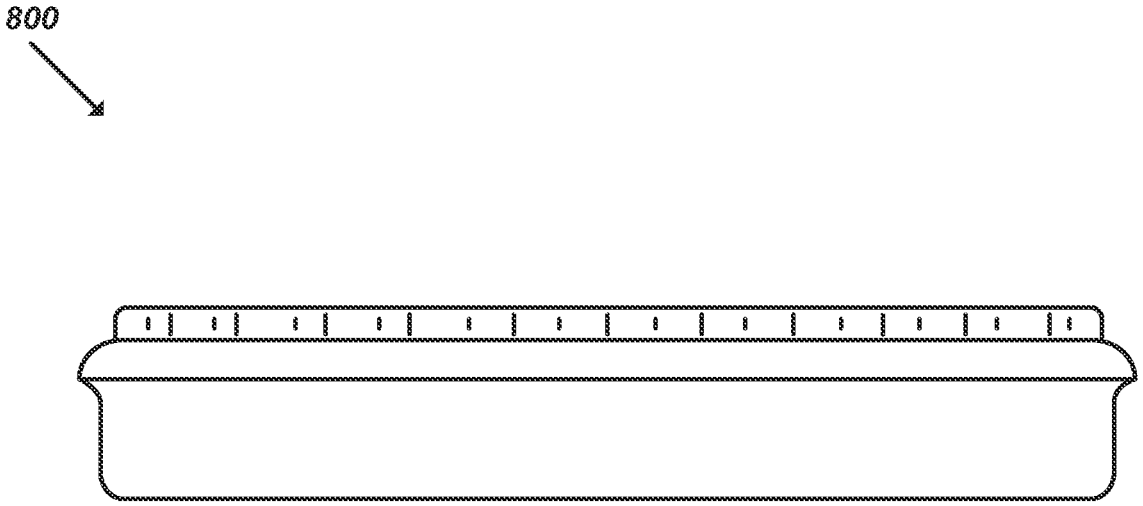
FIG. 9 illustrates a rear elevation view of the second alternative eyelash shaping implement of FIG. 8.

FIG. 8 illustrates a top plan view of a second alternative eyelash shaping implement 800 according to an exemplary embodiment. FIG. 9 illustrates a rear elevation view of the second alternative eyelash shaping implement 800.

The main body and tool engagement elements of the second alternative implement 800 may be similar to those from the example implements 100 and 600 described above.

As shown, the implement 800 may include a set of undulating linear protuberances 810 arranged in an aligned pair. In this example, the protuberances have a flat top surface (i.e., a fixed height along each protuberance). Different embodiments may include protuberances having varying height along the length of the protuberance.

Figure 10:
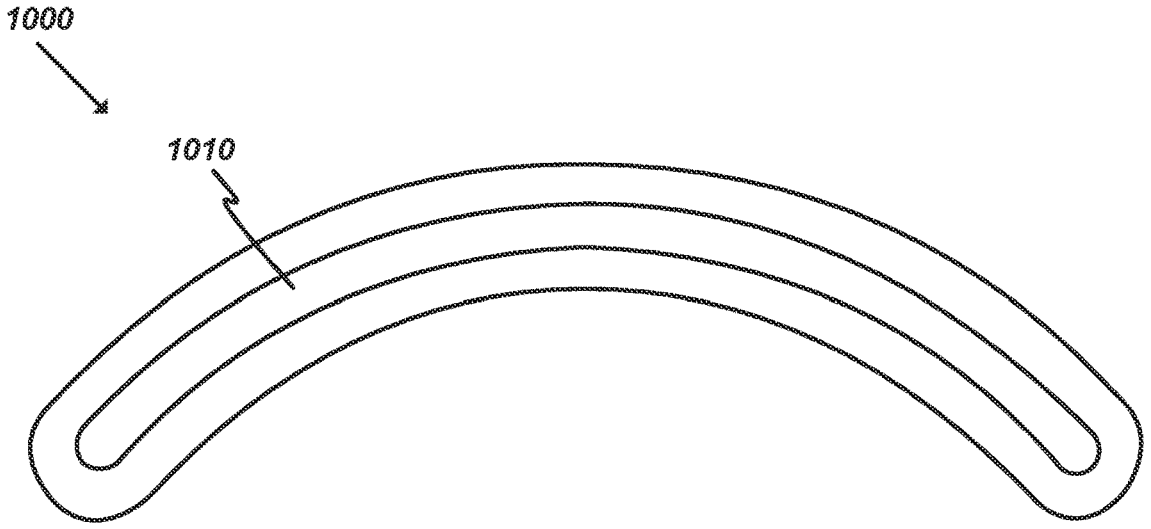
FIG. 10 illustrates a top plan view of a third alternative eyelash shaping implement according to an exemplary embodiment.
Figure 11:
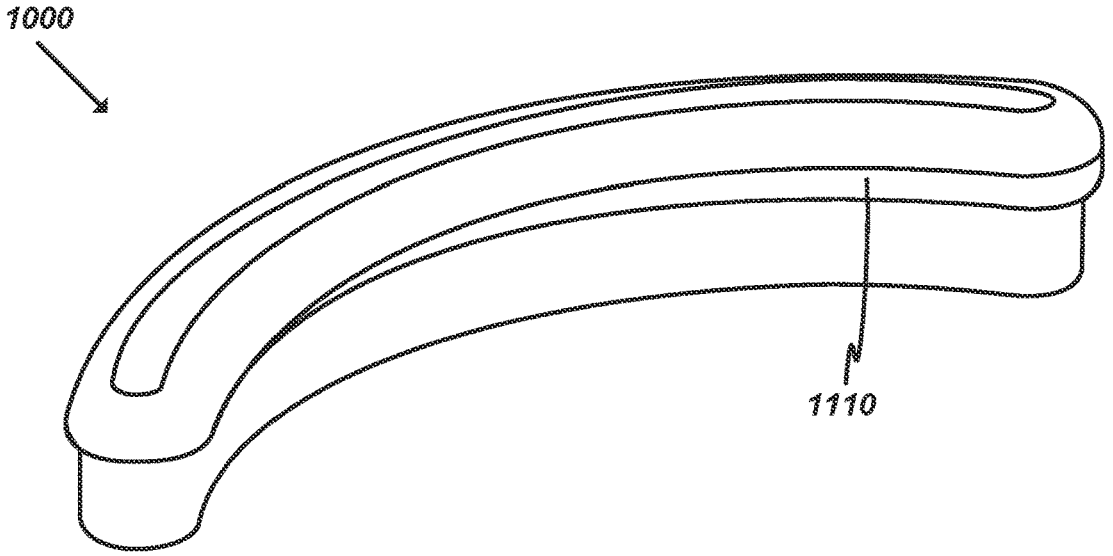
FIG. 11 illustrates a top, front perspective view of the third alternative eyelash shaping implement of FIG. 10.
Figure 12:
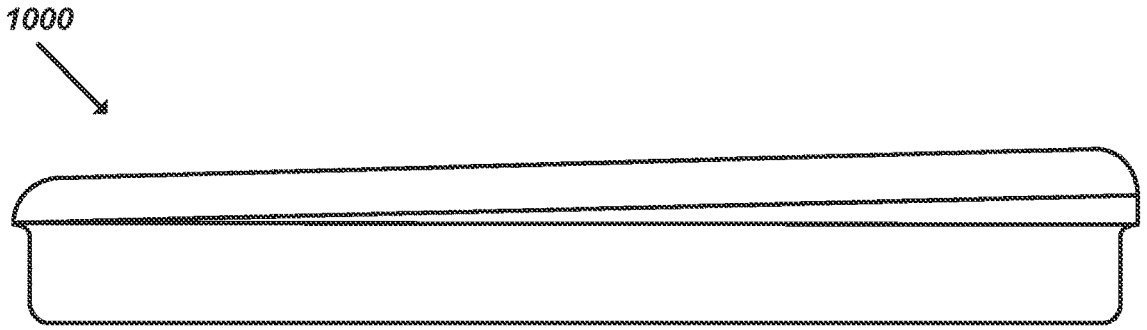
FIG. 12 illustrates a rear elevation view of the third alternative eyelash shaping implement of FIG. 10.

FIG. 10 illustrates a top plan view of a third alternative eyelash shaping implement 1000 according to an exemplary embodiment. FIG. 11 illustrates a top, front perspective view of the third alternative eyelash shaping implement 1000. FIG. 12 illustrates a rear elevation view of the third alternative eyelash shaping implement 1000.

Such an implement 1000 may include a recessed channel 1010 and a tapered layer 1110. The tapered layer 1110 may provide differing compression along the length of the implement 1000. Such a tapered layer 1110 (and resulting tapered engagement surface) may provide more uniform eyelash shaping (or more extreme eyelash shaping) by varying the compression pressure applied to lashes of varying thickness and/or length (e.g., thinner lashes toward the outside of the face may receive less pressure than thicker lashes, or vice versa depending on the desired effect). The tapered layer 1110 may be used with other embodiments including various other shaping features and/or combinations of shaping features along a top surface of the implement 1000.

The tapered layer 1110 of this embodiment ranges from a minimum thickness at one end of the layer to a maximum thickness at the opposite end of the layer along a linear path. Different embodiments may have differently shaped tapered layers. For instance, some embodiments may have a thickest point in the center of the layer, or the thickest point located between the center of the layer and one end, etc. As another example, some embodiments may follow a curved or otherwise shaped path from one end to the other (e.g., a bathtub shaped layer, parabolic layer, sinusoidal layer, saw tooth layer, etc.).

The top surface in this example does not include any shaping elements 120. One of ordinary skill in the art will recognize that the shaping elements may be combined with the tapered layer 1110 in various appropriate ways. For instance, the size, shape, or other attributes of the shaping elements 120 may vary along the tapered layer (e.g., larger shaping elements may be included along a thinner portion of the tapered layer and smaller shaping elements along a thicker portion, or vice-versa).

In this example the implement 1000 may be optimized for a left eye and eyelash such that shaping pressure increases toward the longer lashes at the outside of the eye. A paired implement may include a tapered layer 1110 that slopes in the opposite direction than shown to achieve the same effect on the right eye and eyelash.

Figure 13:
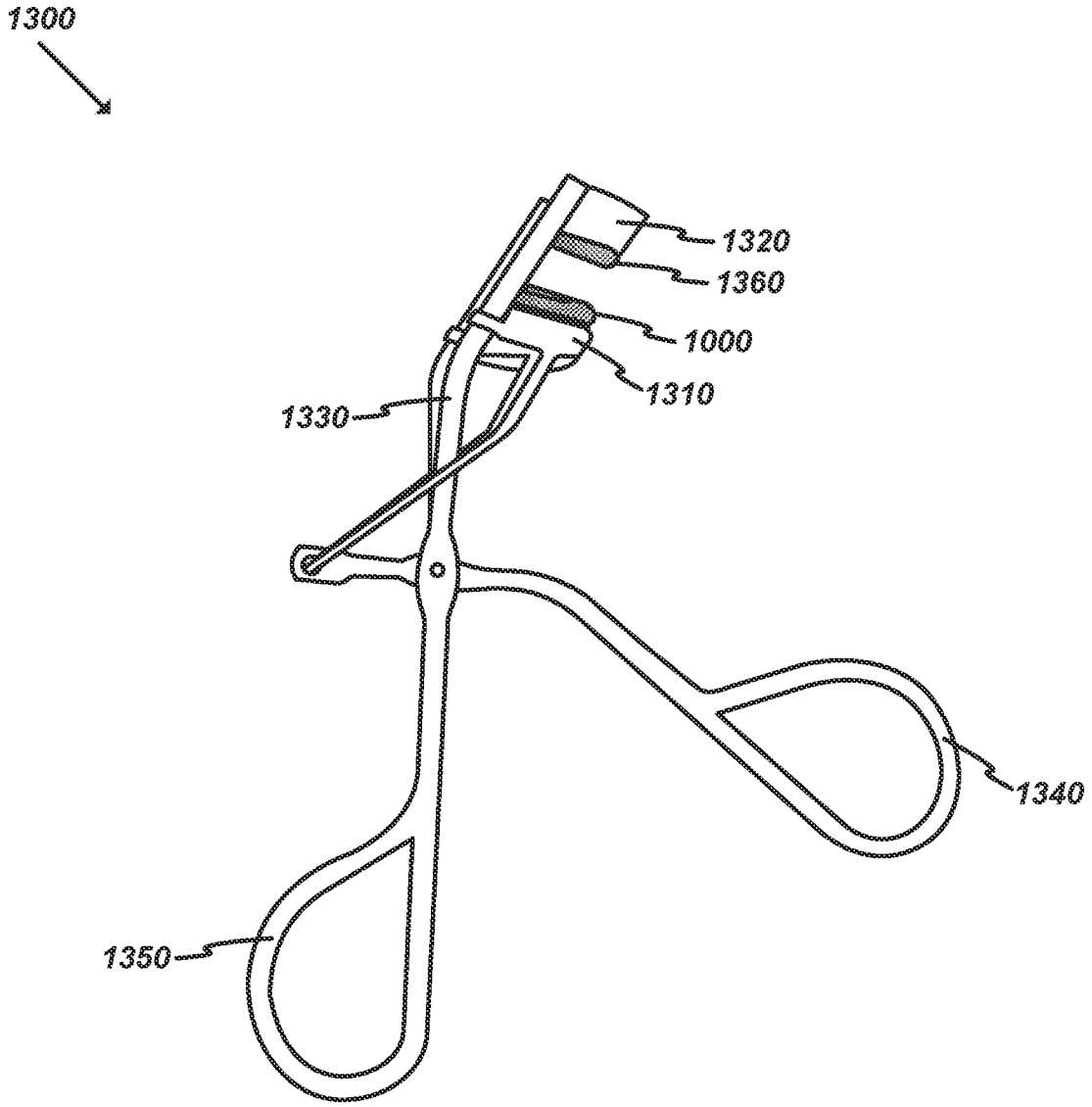
FIG. 13 illustrates a side elevation view of an eyelash curling tool including the third alternative eyelash shaping implement of FIG. 10.
Figure 14:
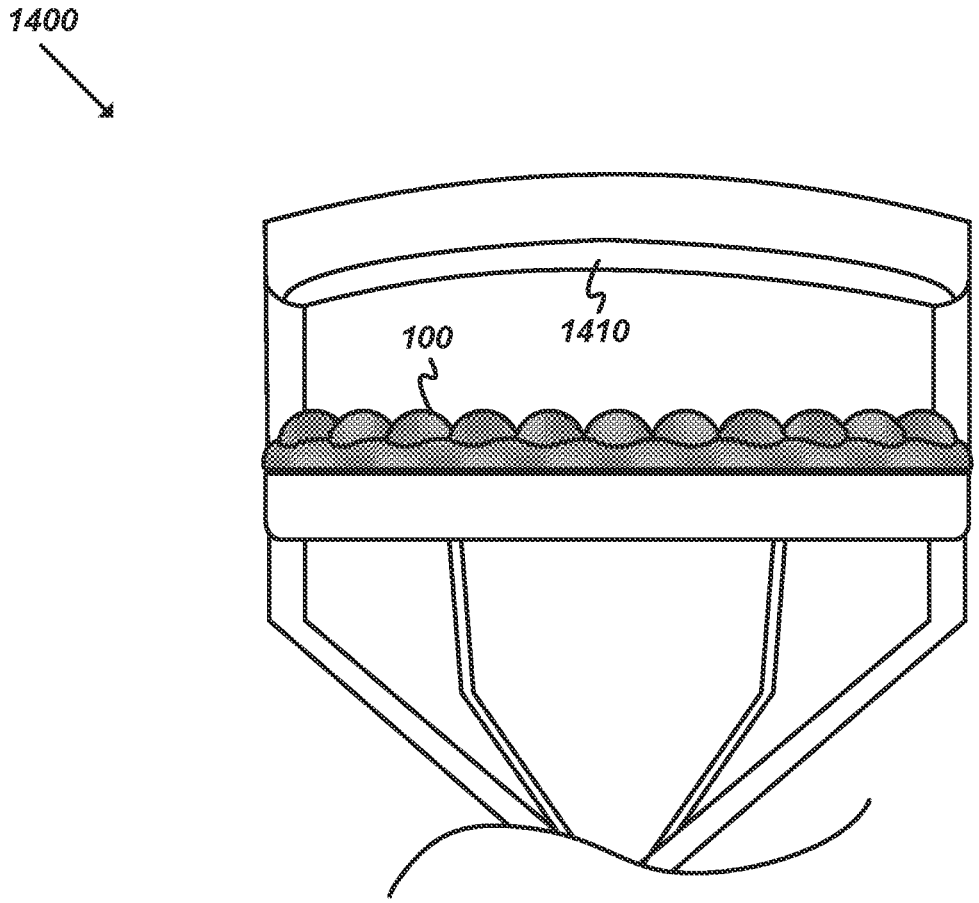
FIG. 14 illustrates a rear elevation view of an eyelash curling tool including the eyelash shaping implement of FIG. 1.
Figure 15:
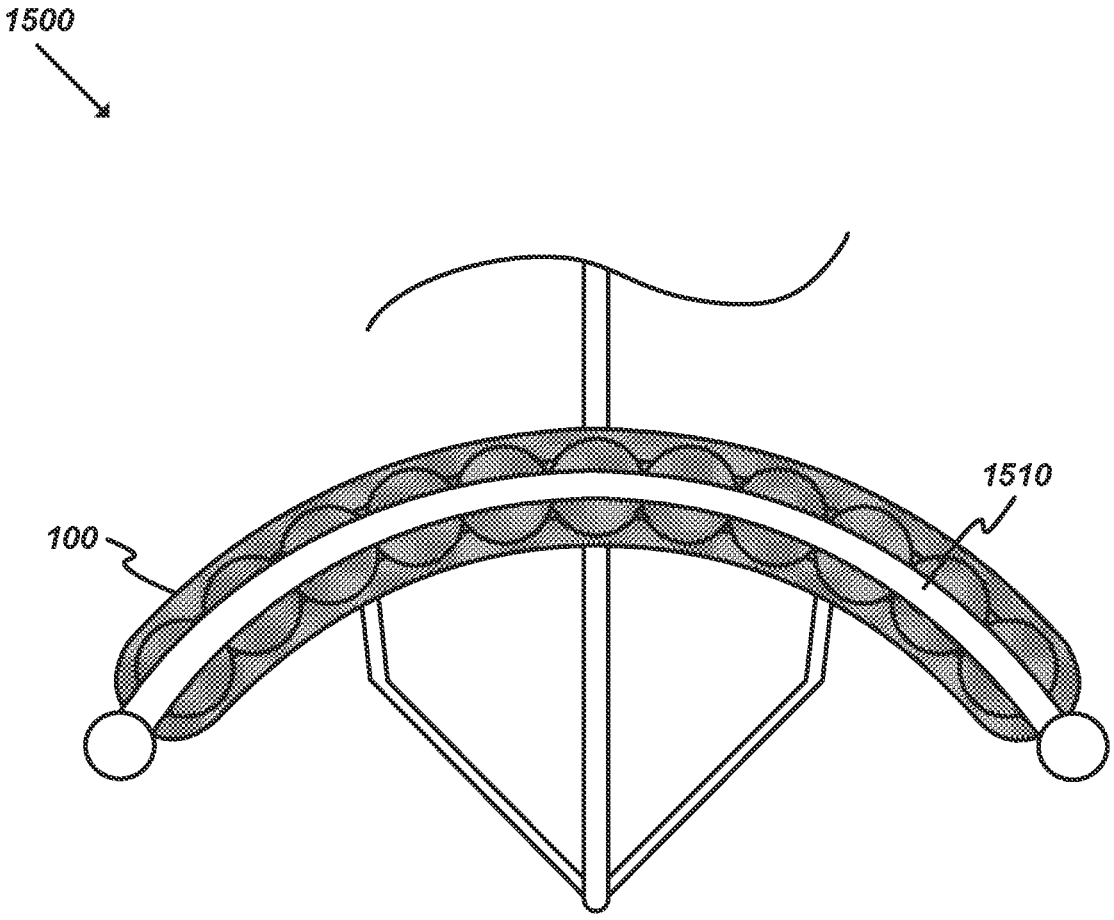
FIG. 15 illustrates a top plan view of an eyelash curling tool including the eyelash shaping implement of FIG. 1.

FIG. 13 illustrates a side elevation view of an eyelash curling tool 1300 including the third alternative eyelash shaping implement 1000. FIG. 14 illustrates a rear elevation view of an eyelash curling tool 1400 including eyelash shaping implement 100. FIG. 15 illustrates a top view of a portion of an eyelash curling tool 1500 including eyelash insert 100.

As shown in the embodiment of FIG. 13, in addition to the insert 1000, the tool 1300 may include a movable section 1310, a fixed section 1320, a pair of linear alignment posts 1330, a manipulation handle 1340 movably coupled to the movable section 1310, a stationary handle 1350 coupled to the posts 1330, and a complementary shaping element 1360.

A user may squeeze the handles 1340-1350 together in order to move section 1310 toward section 1320 in order to apply pressure to the lashes using elements 1000 and 1360 in this example.

In the examples of FIG. 13 and FIG. 14, the complementary shaping elements 1360 and 1410 include a flat surface as shown. Further, in the example of FIG. 15, complementary shaping element 1510 is shown as being narrower than shaping implement 100. Different embodiments may have complementary shaping elements of different thicknesses and with different surfaces.

One of ordinary skill in the art will recognize that different embodiments may be implemented in various different ways without departing from the scope of the disclosure. For instance, in some embodiments the complementary engagement feature may have complementary shaping features along a surface of the engagement feature. Such complementary shaping features may include, for example, spherical recesses, linear recesses, etc. Some embodiments may include shaping features that protrude in a similar, but offset way. For instance, the spherical protuberances described above may be associated with complementary spherical protuberances having a same array that is offset from the main engagement feature such that the top of each shaping feature aligns with a valley between features on the complementary member. As another example, the complementary engagement feature (i.e., the top element) may include various shaping features while the bottom element may be flat, sloped, etc.

The foregoing relates to illustrative details of exemplary embodiments and modifications may be made without departing from the scope of the disclosure as defined by the following claims.

I claim:

1. An eyelash shaping implement comprising:

a curved main body;

a tool engagement element; and a set of hemispherical shaping elements arranged along a surface of the curved main body, wherein the set of shaping elements comprises a first subset of elements aligned along a first path that is offset from a center path of the curved main body, and wherein the set of shaping elements comprises a second subset of elements aligned along a second path that is offset from the center path of the curved main body and the first path.

2. The eyelash shaping implement of claim 1, wherein each of the first subset of elements at least partially overlaps the center path of the curved main body.

3. The eyelash shaping implement of claim 2, wherein each of the second subset of elements at least partially overlaps the center path of the curved main body.

4. The eyelash shaping implement of claim 1, wherein the surface of the curved main body has a constant height relative to the tool engagement element.

5. The eyelash shaping implement of claim 1, wherein the surface of the curved main body follows a linear slope relative to the tool engagement element.

6. An eyelash shaping tool comprising:

a movable section;

a fixed section coupled to the movable section; and a shaping implement comprising:

a curved main body;

a tool engagement element; and a set of hemispherical shaping elements arranged along a surface of the curved main body, wherein the set of shaping elements comprises a first subset of elements aligned along a first path that is offset from a center path of the curved main body, and wherein the set of shaping elements comprises a second subset of elements aligned along a second path that is offset from the center path of the curved main body and the first path.

7. The eyelash shaping tool of claim 6, wherein each of the first subset of elements at least partially overlaps the center path of the curved main body.

8. The eyelash shaping tool of claim 7, wherein each of the second subset of elements at least partially overlaps the center path of the curved main body.

9. The eyelash shaping tool of claim 6 further comprising a complementary shaping implement having at least one shaping element along a surface of the complementary shaping implement.

10. The eyelash shaping tool of claim 6 further comprising a complementary shaping implement having at least one receptacle able to accept at least a portion of at least one shaping element from the set of shaping elements.

11. An eyelash shaping insert:

a curved main body; and a set of hemispherical shaping elements arranged along a surface of the curved main body, wherein the set of shaping elements comprises a first subset of elements aligned along a first path that is offset from a center path of the curved main body, and wherein the set of shaping elements comprises a second subset of elements aligned along a second path that is offset from the center path of the curved main body and the first path.

12. The eyelash shaping insert of claim 11, wherein each of the first subset of elements at least partially overlaps the center path of the curved main body.

13. The eyelash shaping insert of claim 12, wherein each of the second subset of elements at least partially overlaps the center path of the curved main body.

14. The eyelash shaping insert of claim 11 further comprising a tool engagement element, wherein the surface of the curved main body follows a linear slope relative to a base of the tool engagement element.

* * * * *